US008529184B1

(12) United States Patent
Hanser et al.

(10) Patent No.: US 8,529,184 B1
(45) Date of Patent: Sep. 10, 2013

(54) SADDLE RACK LIFT MECHANISM

(75) Inventors: Paul Hanser, Tipton, IA (US); Vincent Buls, Tipton, IA (US)

(73) Assignee: HWH Corporation, Moscow, IA (US)

( * ) Notice: Subject to any disclaimer, the term of this patent is extended or adjusted under 35 U.S.C. 154(b) by 483 days.

(21) Appl. No.: 12/820,828

(22) Filed: Jun. 22, 2010

(51) Int. Cl.
*B66C 23/00* (2006.01)

(52) U.S. Cl.
USPC ..... 414/743; 211/85.11

(58) Field of Classification Search
USPC ..... 414/743, 917; 211/85.11; 248/130
See application file for complete search history.

(56) References Cited

U.S. PATENT DOCUMENTS

| | | | | |
|---|---|---|---|---|
| 7,500,573 | B1 * | 3/2009 | Flynn | 211/85.11 |
| 7,669,809 | B1 | 3/2010 | Toner et al. | |
| 7,874,436 | B2 * | 1/2011 | Hought | 211/85.11 |
| 7,942,277 | B1 * | 5/2011 | Flynn | 211/85.11 |
| 2010/0116950 | A1 * | 5/2010 | Tallent et al. | 248/130 |

* cited by examiner

*Primary Examiner* — Jonathan Snelting
(74) *Attorney, Agent, or Firm* — Jason R. Sytsma; Shuttleworth & Ingersoll, PLC

(57) ABSTRACT

According to the present invention, there is provided a lift mechanism adapted for movement between a substantially horizontal position and a substantially vertical position. At least one saddle rack adapted to carry a horse saddle is combined to the lift mechanism and positively rotates with respect to the lift mechanism in rotational synchronization with the movement of the lift mechanism as the lift mechanism moves between the respective positions, such that the horse saddle is held in a substantially upright position throughout the lift mechanism's movement.

11 Claims, 7 Drawing Sheets

SADDLE RACK LIFT MECHANISM

FIELD

The present invention relates to an apparatus for lifting and storing horse saddles, and more specifically the invention relates to a saddle lift apparatus for maintaining the saddles in a substantially upright position while moving the saddles between a substantially horizontal position for loading and unloading and a substantially vertical position for storing.

BACKGROUND

When not in use, horse saddles are typically stored on saddle supports which generally maintain the shape of the saddles. The simplest form of saddle support which is used for the storage of saddles is a horizontal wooden beam such as a two-by-four on which the saddle is placed. However, the saddle has a tendency to easily fall from the beam.

Horses are frequently transported for show and/or riding purposes. Therefore, horse saddles frequently require transportation with the horses. Commonly, horse saddles are placed on the floor of a horse trailer or the like for transportation. However, the lack of a user-friendly saddle storage system increases the risk of injury to persons attempting to move and store the saddles. In addition, lack of a suitable support for the saddle during transportation may cause the saddle to lose its optimum shape over time.

SUMMARY

According to the present invention, there is provided a lift mechanism adapted for movement between a substantially horizontal position and a substantially vertical position. At least one saddle rack adapted to carry a horse saddle is combined to the lift mechanism and positively rotates with respect to the lift mechanism in rotational synchronization with the movement of the lift mechanism between the respective positions, such that the horse saddle is held in a substantially upright position throughout the lift mechanism's movement.

In another embodiment of the invention, there is provided a method for carrying and storing a horse saddle. A lift mechanism is provided with attached saddle racks. Movement of the lift mechanism between a substantially horizontal position and a substantially vertical position is synchronized with a positive rotation of the saddle rack in order to hold the saddle rack in a substantially upright position as the lift mechanism moves between respective positions.

In yet another embodiment, there is provided a saddle rack lift apparatus adapted for movement between a substantially horizontal position and a substantially vertical position. A plurality of adjacent saddle racks are combined to the lift mechanism. Each of the plurality of saddle racks has an axis of rotation with respect to the lift mechanism and a spine offset from the axis of rotation. The offset distance between the spine and the axis of rotation of the plurality of saddle racks is varied, such that when the lift mechanism moves from the horizontal position to the vertical position, the distance between the spines of adjacent saddle racks decreases.

Other aspects, features, and embodiments of the invention will become apparent upon review of the following description taken in connection with the accompanying drawings. The invention, though, is pointed out with particularity by the appended claims.

BRIEF DESCRIPTION OF THE ILLUSTRATED EMBODIMENTS

DETAILED DESCRIPTION

FIGS. 1-10 depict an exemplary embodiment of a saddle rack lift apparatus 10. Saddle rack lift apparatus 10 is adapted to maintain horse saddles in a substantially upright position while saddle rack lift apparatus 10 moves between a substantially horizontal position for loading and unloading the horse saddles and a substantially vertical position for storing the horse saddles.

Saddle rack lift apparatus 10, includes base 12 which is adapted for mounting on a surface. Such a surface can be any supportive structure capable of supporting the weight of saddle rack lift apparatus 10 and attaching it thereto, for example, a floor in a garage or other storage facility or a floor in a horse trailer or other support vehicle. Base 12 includes two sections of opposing angle iron 12*a*, 12*b* joined by square tubing 12*c*; however, one skilled in the art would recognize that base 12 can include multiple arrangements of tubing or plates, so long as it is capable of supporting saddle rack lift apparatus 10.

Figure 2:
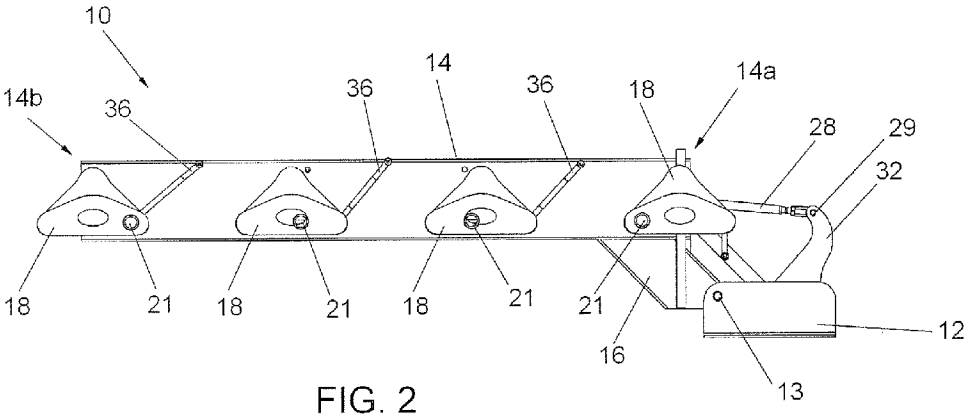
FIG. 2 is a side view of the saddle rack mechanism of FIG. 1 with multiple saddle racks in a lowered, substantially horizontal position.
Figure 3:
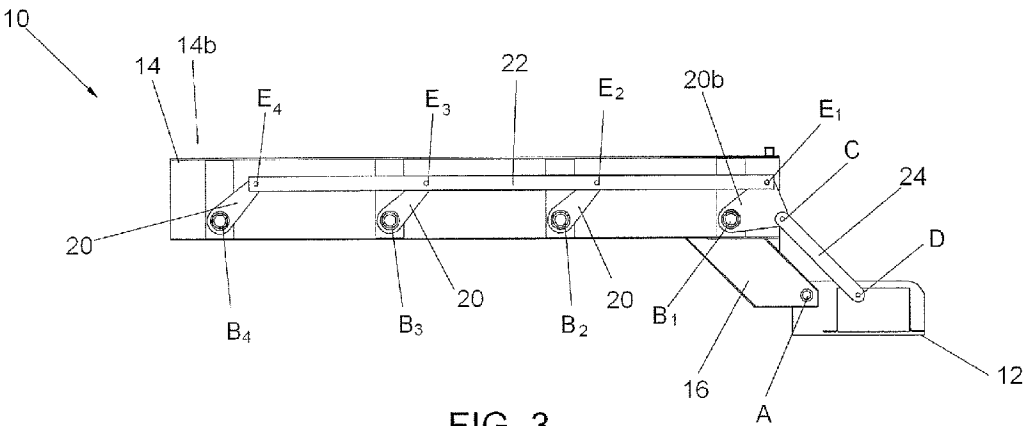
FIG. 3 is a side cut-away view of the saddle rack mechanism of FIG. 2 illustrating a timing mechanism.
Figure 4:
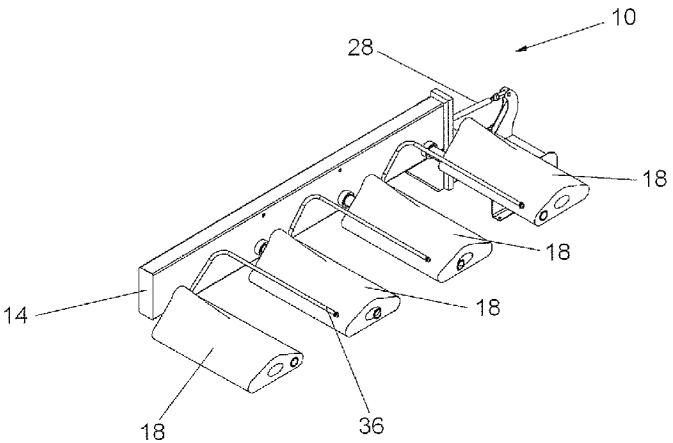
FIG. 4 is a frontward perspective view of the saddle rack mechanism of FIG. 2 with multiple saddle racks in a lowered, substantially horizontal position.
Figure 5:
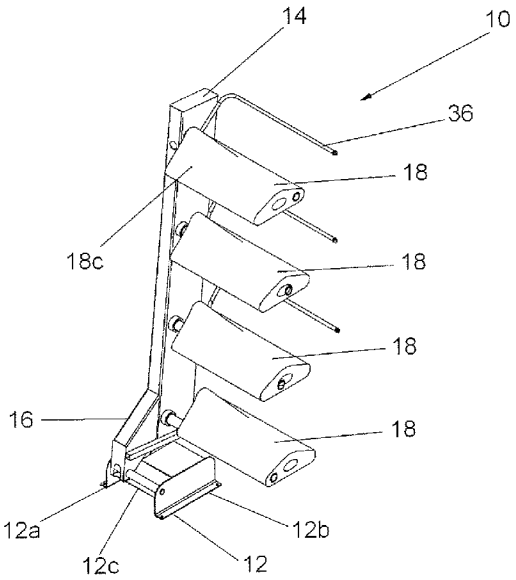
FIG. 5 is a perspective view of the saddle rack mechanism of FIG. 4 with multiple saddle racks in a raised, substantially vertical position.

An elongated beam 14, which may be made of rectangular tubing, is pivotally combined to base 12 by driving arm 16. Elongated beam 14 has proximate and distal ends 14*a*, 14*b*, respectively. One end of driving arm 16 is attached to proximate end 14*a* of elongated beam 14 and the other end of driving arm 16 is pivotally combined to base 12 by pivot pin 13. As illustrated in FIGS. 2, 3, and 5, driving arm 16 elevates beam 14 above base 12 to a vertical storage position (FIG. 5) and holds elongated beam 14 horizontal off the ground or mounting surface to provide easy access to saddles resting on saddle rack 18.

Figure 5A:
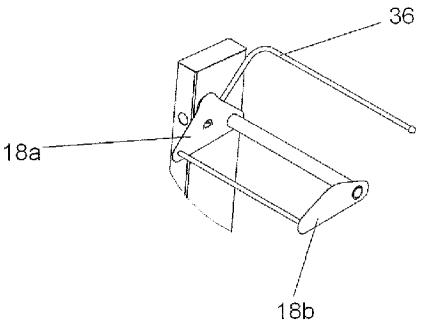
FIG. 5A is a saddle rack from FIG. 5 with the covering removed to expose the inside of the saddle rack.
Figure 6:
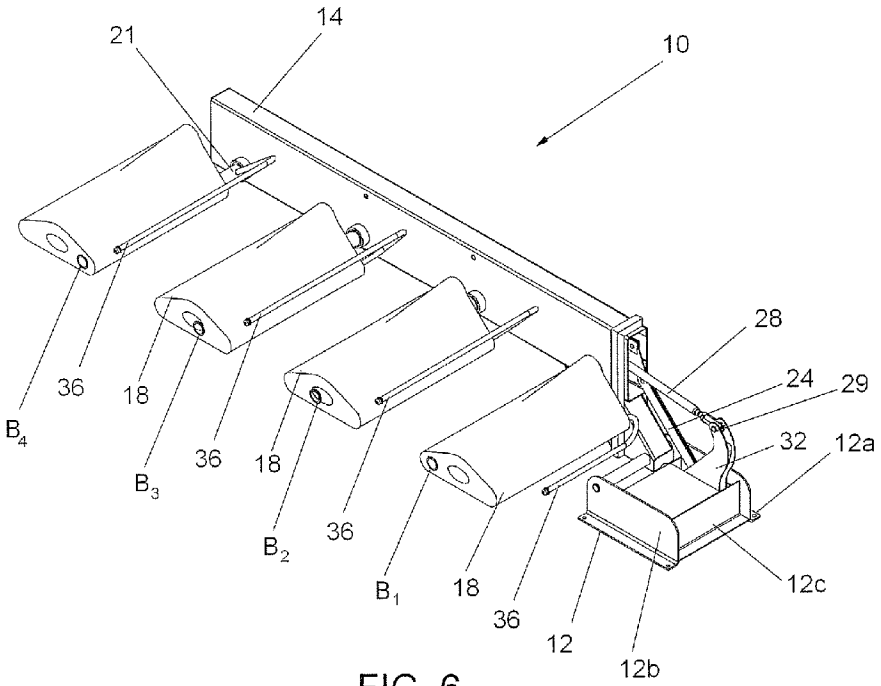
FIG. 6 is a rearward perspective view of the saddle rack mechanism of FIG. 4 with multiple saddle racks in a lowered, substantially horizontal position.

A plurality of saddle racks 18 are spaced apart along the length of elongated beam 14. Saddle racks 18 are each configured to support and carry a horse saddle, and therefore have a profile configured to mate with the underside of a horse saddle. Referring to FIG. 5A, saddle racks 18 include opposing end-plates 18*a*, 18*b* that have matching profiles similar to the underside of each end of a horse saddle. A cover 18*c* of stretchable fabric is stretched across end-plates 18*a*, 18*b* and secured at each end. This creates a mounting surface that forms to the profile of a saddle. After time, stretchable fabric cover 18*c* over each saddle rack 18 will conform to the profile of a corresponding horse saddle. Since no two saddles 18 are identical, a uniquely formed saddle rack 18 prevents the horse saddle's spine from warping. Moreover, each horse saddle is more stable when it is mounted on a uniquely formed saddle rack 18.

Referring back to FIGS. 2 and 3, each saddle rack 18 is pivotally combined to elongated beam 14 by a shaft 21. Each saddle rack 18 is affixed to a respective shaft 21 so that as shaft 21 turns, the saddle rack 18 will pivot and rotate with respect to elongated beam 14. Each shaft 21 is attached to a cam 20 and cam 20 is pivotally combined to timing bar 22. The plurality of saddle racks 18 rotate about corresponding axes of rotation $B_1$, $B_2$, $B_3$, and $B_4$ about which corresponding shafts 21 rotate. The saddle racks 18 are joined together by timing bar 22 for synchronized rotation about their respective axes $B_1$, $B_2$, $B_3$, and $B_4$.

Timing bar 22 extends within elongated beam 14 to connect each cam 20 at pivot points $E_1$, $E_2$, $E_3$, and $E_4$. Timing bar 22 is connected at its proximate end to master cam 20*b*. Master cam 20*b* is also pivotally combined to the end of follower arm 24, which in turn is pivotally connected at its other end to base 12. Since all cams 20 are combined to base 12 through follower arm 24, when follower arm 24 pivots about base 12, saddle racks 18 pivot about their respective axes $B_1$, $B_2$, $B_3$, and $B_4$. The aforesaid arrangement synchronizes the rotation of saddle racks 18 about their respective axes $B_1$, $B_2$, $B_3$, and $B_4$ with the movement of saddle rack lift apparatus 10 between the substantially horizontal and the substantially vertical position.

FIG. 3 depicts a parallelogram type four-bar mechanism formed by follower arm 24, driving arm 16, base 12 and master cam 20*b*. Driving arm 16 pivots about base 12 at pivot point A, master cam 20*b* rotates about axis or pivot point $B_1$, one end of follower arm 24 pivots about master cam 20*b* at pivot point C, and the other end of follower arm 24 pivots about base 12 at pivot point D. A line segment represented by the distance between pivot point A and pivot point D remains horizontal and parallel to a line segment represented by the distance between pivot point $B_1$ and pivot point C. A line segment represented by the distance between pivot point A and pivot point $B_1$ is equal in length and parallel to a line segment represented by the distance between pivot point C and pivot point D. The resulting line segments form a parallelogram. As such, the line segments formed by opposing parallel driving arm 16 and follower arm 24 remain parallel and pivot about their respective pivot points, A and D, respectively, at the same angular velocity. Accordingly, saddle racks 18 rotate about corresponding axes of rotation $B_1$, $B_2$, $B_3$, and $B_4$ at the same angular velocity as elongated beam moves between its substantially horizontal and substantially vertical position. Unlike prior art saddle rack lift apparatus that rely solely on gravity to keep the horse saddles upright, saddle rack lift apparatus 10 uses the described parallelogram linkage to synchronize the rotation of saddle racks 18 with movement of elongated beam 14, thereby positively forcing saddle racks 18 to remain parallel with the ground.

Illustrated in FIGS. 2, 4, 6, and 8-10 a hydraulic cylinder 26 is provided to automate movement of saddle rack lift apparatus 10. Although the instant disclosure is discussed in terms of a hydraulic cylinder 26, any type of cylinder 26 may be used to automate movement of saddle rack lift apparatus 10, such as electric or pneumatic cylinders. Hydraulic cylinder 26 is pivotally combined inside elongated beam 14 and base 12.

Figure 8:
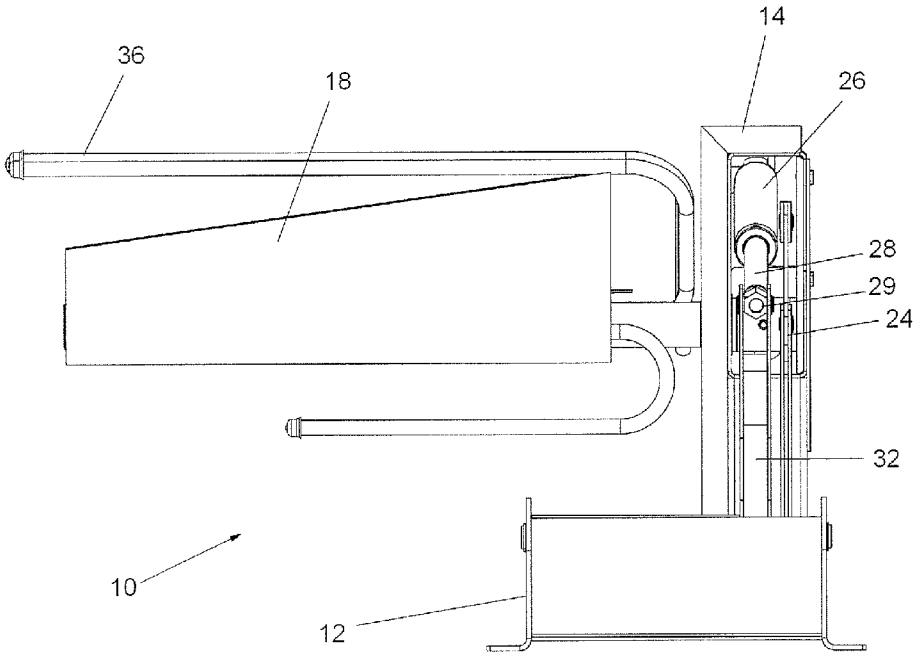
FIG. 8 is a rear view of the saddle rack mechanism of FIG. 6 with multiple saddle racks in a lowered, substantially horizontal position.
Figure 7:
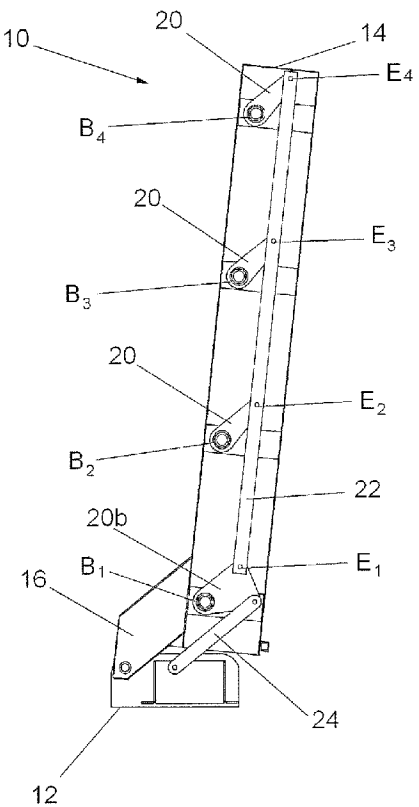
FIG. 7 is a side cut-away view of the saddle rack mechanism of FIG. 5 with multiple saddle racks in a raised, substantially vertical position.
Figure 9:
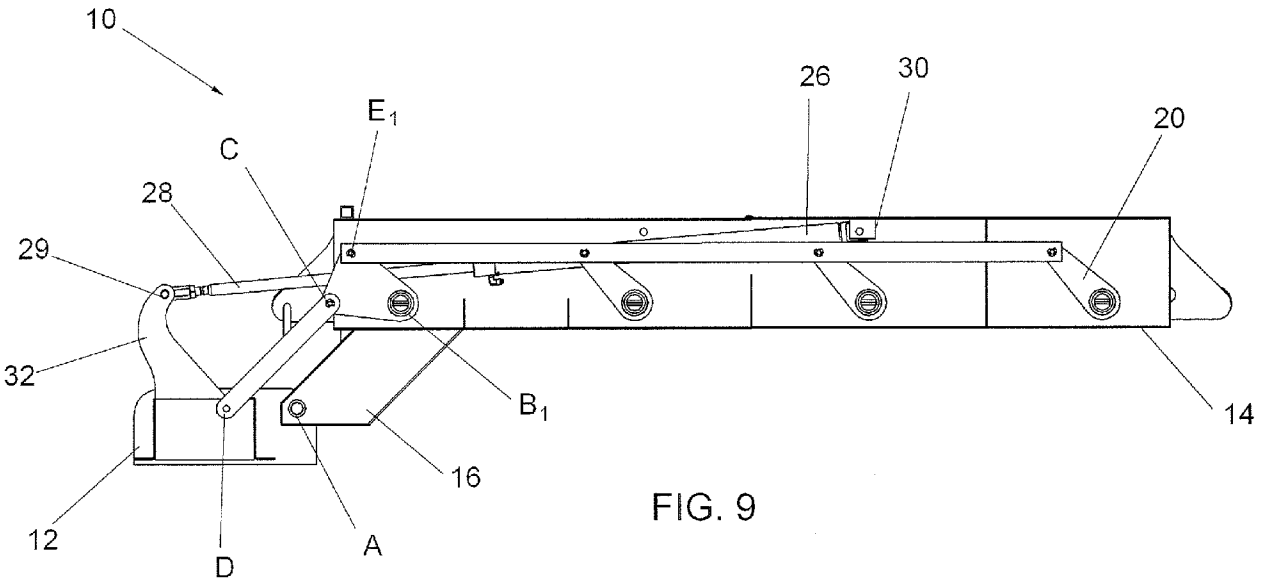
FIG. 9 is a side cut-away view of the saddle rack mechanism of FIG. 8 illustrating the position of the hydraulic cylinder inside the elongated beam.
Figure 10:
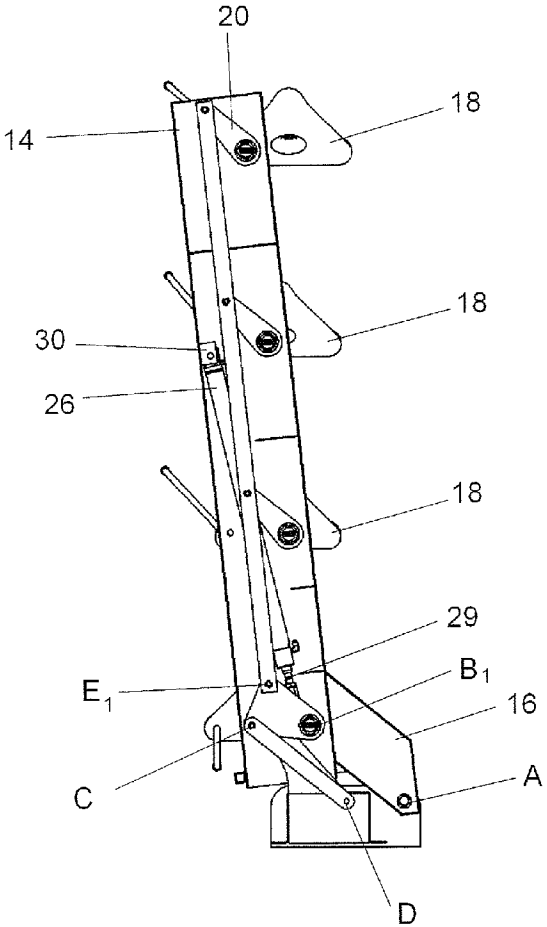
FIG. 10 is a side cut-away view of the saddle rack mechanism of FIG. 9 with multiple saddle racks in a raised, substantially vertical position and illustrating the position of the hydraulic cylinder inside the elongated beam.

Referring to FIGS. 8-10, hydraulic cylinder 26 is positioned within elongated beam 14 to prevent hydraulic cylinder's 26 moving piston 28 from getting tangled in the horse saddles or exposing them to hydraulic fluid. Hydraulic cylinder 26 is pivotally attached inside elongated beam 14 at an anchor 30 and its piston 28 is pivotally combined with upright member 32 at a pivot point 29. A triangular plane formed by line segments extending between pivot point 29 and anchor 30, pivot point 29 and pivot point A, and anchor 30 and pivot point A exerts a moment of force to rotate elongated beam 14 about pivot point A to raise and lower elongated beam 14.

To move saddle rack lift apparatus 10 between the storage and access positions, hydraulic cylinder 26 is actuated. When saddle rack lift apparatus 10 is in the horizontal access position, piston 28 is extended. To move saddle rack lift apparatus 10 to the vertical storage position, piston 28 retracts into cylinder 26. Piston 28 is pivotally combined to upright member 32 which in turn is fixed to base 12. Because piston 28 pivots about upright member 32 at pivot point 29, axial movement of piston 28 is converted to rotational movement of elongate beam 14.

Figure 1:
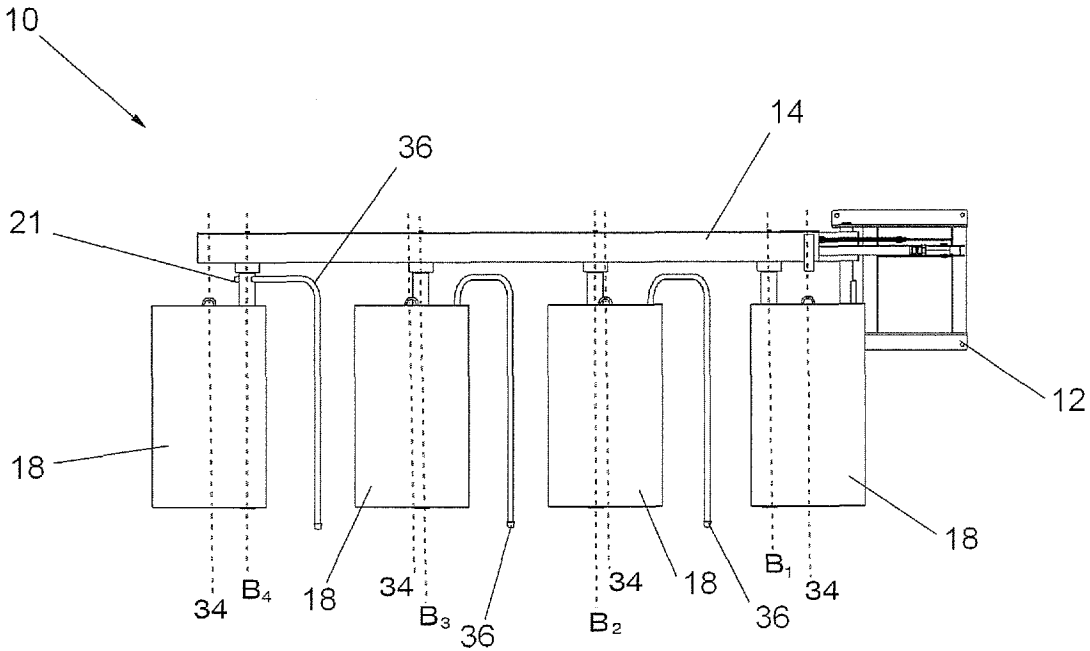
FIG. 1 is a top view of a saddle rack mechanism, with multiple saddle racks in a lowered, substantially horizontal position.

Saddle rack lift apparatus 10 also provides more space between saddle racks 18 when saddle rack lift apparatus 10 is in the horizontal access position than when saddle rack lift apparatus 10 is in the vertical storage position. Referring to FIG. 1, each saddle rack 18 has a spine 34 which is offset from its corresponding rotational axis $B_1$, $B_2$, $B_3$, and $B_4$. Rotational axes $B_1$, $B_2$, $B_3$, and $B_4$ are substantially equidistant apart. When elongated beam 14 is in the horizontal access position, the offset for corresponding saddle racks 18 is oriented on the side of the pivot away from the center of the elongated beam 14. Accordingly, when saddle rack lift apparatus 10 is horizontal, the distance between corresponding spines 34 is greater that the distance between corresponding rotational axes $B_1$, $B_2$, $B_3$, and $B_4$. As elongated beam 14 moves toward the vertical storage position, the distance between spines 34 of corresponding saddle racks 18 decrease, such that when elongated beam 14 is substantially vertical, spines 18 of saddle racks 18 are spaced approximately the same distance from each other as their respective axes $B_1$, $B_2$, $B_3$, and $B_4$. The offset between spines 34 and corresponding axes $B_1$, $B_2$, $B_3$, and $B_4$ allows each horse saddle to have maximum spacing when saddle rack lift apparatus 10 is in the lowered, horizontal access position to make loading and unloading horse saddles easier, while providing a compact storage position for the horse saddles when saddle rack lift apparatus 10 is in the raised, vertical storage position.

Saddle rack lift apparatus 10 also has several features to protect the horse saddle by providing air flow to remove moisture content from it after its been used. As previously stated, cover 18*c* is made of a stretchable fabric that is porous to allow moisture to escape from the underside of the horse saddle. Also, a saddle curtain hanging on saddle curtain rod 36 is provided on each saddle rack 18. Saddle curtain is a stretchable piece of fabric that hangs off saddle curtain rod 36. In the lowered, substantially horizontal position, the saddle curtain hangs down from saddle curtain rod 36. As saddle rack lift apparatus 10 is raised toward the substantially vertical position, the saddle curtain begins to lay over an adjacent lower horse saddle to cover it and prevent adjacent horse saddle stirrups from lying on it or directly rubbing against it.

While the present invention has been particularly shown and described with reference to exemplary embodiments thereof, it should be understood by those of ordinary skill in the art that various changes, substitutions and alterations can be made herein without departing from the scope of the invention as defined by appended claims and their equivalents. The invention can be better understood by reference to the following claims. For purpose of claim interpretation, the transitional phrases "including" and "having" are intended to be synonymous with the transitional phrase "comprising."

What is claimed is:

1. A saddle rack lift apparatus, comprising:

a lift mechanism adapted for movement between a substantially horizontal position and a substantially vertical position; and a plurality of adjacent saddle racks adapted to carry a corresponding plurality of saddles, the plurality of saddle racks combined to the lift mechanism, each of the plurality of saddle racks having an axis of rotation with respect to the lift mechanism and a spine offset from the axis of rotation in order to decrease a distance between the spines of adjacent saddle racks when the lift mechanism moves from the horizontal position to the vertical position.

2. The apparatus of claim 1, and further comprising a timing mechanism to synchronize the movement of the lift mechanism with a positive rotation of the saddle racks in order to hold the saddles in a substantially upright position as the lift mechanism moves between the substantially horizontal position and the substantially vertical position.

3. The apparatus of claim 2, wherein the timing mechanism is a parallelogram type four-bar mechanism.

4. The apparatus of claim 3, wherein the parallelogram type four-bar mechanism comprises a base for the lift mechanism, a timing bar that combines the plurality of saddle racks, and a parallelogram linkage connecting the base to the timing bar in order to synchronize rotation of the plurality of saddle racks with the movement of the lift mechanism between the substantially horizontal position and the substantially vertical position.

5. The apparatus of claim 1, and further comprising a plurality of curtain rods combined to the corresponding plurality of saddle racks, wherein the curtain rods are adapted to carry a curtain to lay over an adjacent lower horse saddle in order to minimize adjacent horse saddles from rubbing against each other.

6. The apparatus of claim 1, and further comprising a cylinder to move the lift mechanism between the substantially horizontal position and the substantially vertical position.

7. The apparatus of claim 6, and further comprising a timing mechanism to synchronize the movement of the lift mechanism with the rotation of the saddle racks in order to hold the saddles in a substantially upright position as the lift mechanism moves between the substantially horizontal position and the substantially vertical position.

8. A saddle rack lift apparatus, comprising:

a lift mechanism adapted for movement between a substantially horizontal position and a substantially vertical position; and a plurality of saddle racks each being adapted to carry a saddle, the saddle racks being combined to the lift mechanism to positively rotate with respect to the lift mechanism in rotational synchronization with the movement of the lift mechanism as the lift mechanism moves between the substantially horizontal position and the substantially vertical position, such that the saddle is held in a substantially upright position as the lift mechanism moves between the substantially horizontal position and the substantially vertical position wherein the plurality of saddle racks each have an axis of rotation, and the plurality of saddle racks each further comprising a spine offset from the axis of rotation in order to decrease a distance between the spines of adjacent saddles when the lift mechanism moves between the substantially horizontal position and the substantially vertical position.

9. The apparatus of claim 8, and further comprising a timing mechanism to synchronize the rotation of the plurality of saddle racks with the movement of the lift mechanism between the substantially horizontal position and the substantially vertical position.

10. The apparatus of claim 9, and further comprising a base and a parallelogram linkage connecting the base to the timing mechanism in order to synchronize rotation of the plurality of saddle racks with the movement of the lift mechanism between the substantially horizontal position and the substantially vertical position.

11. The apparatus of claim 10, and wherein the timing mechanism is a timing bar.

* * * * *